US005454195A

United States Patent [19]

Hallsten

[11] Patent Number: 5,454,195

[45] Date of Patent: Oct. 3, 1995

[54] MODULAR CONTAINMENT SYSTEM FOR HAZARDOUS MATERIALS

[75] Inventor: Jeffrey A. Hallsten, Sacramento, Calif.

[73] Assignee: Hallsten Corporation, Sacramento, Calif.

[21] Appl. No.: 4,917

[22] Filed: Jan. 19, 1993

[51] Int. Cl.[6] ..... B65G 5/00

[52] U.S. Cl. ..... 52/169.1; 4/506; 52/169.7; 220/404; 405/52; 405/114

[58] Field of Search ..... 588/249; 405/52, 405/53, 55, 107, 114, 128, 129; 220/404; 4/506; 52/169.7, 169.1

[56] References Cited

U.S. PATENT DOCUMENTS

| | | | |
|---|---|---|---|
| 2,961,731 | 11/1960 | Buzzell et al. | 405/114 X |
| 3,959,830 | 1/1976 | van den Broek | 4/506 X |
| 4,031,676 | 6/1977 | Dally | 405/107 X |
| 4,632,602 | 12/1986 | Hovnanian | 405/128 |
| 4,765,775 | 8/1988 | Kroger | 405/52 |
| 4,802,322 | 2/1989 | Bendfeld | 405/52 X |
| 4,881,847 | 11/1989 | Sandels | 405/52 |
| 5,108,225 | 4/1992 | Neal | 405/53 |
| 5,114,274 | 5/1992 | Heiler | 405/128 |

OTHER PUBLICATIONS

Hi Tech Berms Inc. (brochure), pp. 1–4, of Vancouver Canada (publication date unknown).

*Primary Examiner*—Randolph A. Reese
*Assistant Examiner*—John A. Ricci
*Attorney, Agent, or Firm*—Thomas M. Freiburger

[57] ABSTRACT

A modular containment system, primarily for secondary containment of potentially hazardous materials, includes a series of interconnectable berm members which can be interlocked together to form virtually any desired containment perimeter. A sheet of flexible plastic material is laid over the containment area, and extends over the shoulders of the perimeter structure as a liner for the containment area. The liner is secured to the top of the perimeter structure, such as by a snap-in tube arrangement. For high stability of the perimeter structure, the modular berm members are hollow, formed of plastic material, to be filled with water or sand, as well as having a low, wide profile.

10 Claims, 10 Drawing Sheets

MODULAR CONTAINMENT SYSTEM FOR HAZARDOUS MATERIALS

BACKGROUND OF THE INVENTION

This invention relates generally to secondary containment systems, typically used in a variety of industries which use or produce hazardous materials. More specifically the invention is concerned with containment systems made Up of hollow modules which can be interconnected by interlocking projections and grooves, whereby the modules can be connected to form a variety of perimeters, with the enclosed area covered by a lining which attaches to the modular perimeter.

There is a growing need for improved containment systems for use with hazardous chemicals and other materials. Increasingly stringent environmental regulations require secondary containment systems for materials which have previously been stored in simple drums with no back-up containment. Additionally, in many industrial procedures involving hazardous chemicals and other potentially hazardous materials, a containment system is required that will catch hazardous substances that would otherwise fall onto the ground. For example, when removing lead paint from structures, the lead paint particles should be prevented from falling onto and polluting the ground. As another example, storage drums which are filled with hazardous materials and may be subject to eventual leakage should be provided with a secondary containment system that will trap any materials leaking from a ruptured container.

Such secondary containment is required by law in an increasing number of circumstances.

One example of a previous containment system for trapping spilled hazardous materials was a large plastic bathtub-shaped product, of sufficient size that two 55 gallon drums Could be placed upright inside the tub. Should the 55 gallon drums develop a leak, any spilled materials would flow into the tub rather than onto the surrounding ground or floor. However, there is a need for larger and more versatile secondary containment systems.

Another example of a containment system for containing spilled hazardous materials is a modular berm system developed by Hi Tech Berms, Inc. of Canada. The Hi Tech Berm system is comprised of vertically oriented modules which can be interconnected with interlocking swivel connectors, allowing the modules to be assembled in a variety of configurations. However, the interlocking swivel connectors, as well as the lack of stability of the modules, make the system highly susceptible to outward pressure against the modules, whereby the modules have a tendency to be forced outward so the assembled structure will tend to form a shape of least resistance, i.e. a circle resisting pressure only by hoop strength. Additionally, the modules have narrow bases, so that they are susceptible to tipping over.

Another method for forming a containment system, especially for large, outdoor applications, has been to form earthen berms, making a perimeter enclosed with a ridge of dirt. A liner is placed over the enclosed area, and the lineris held in place on the dirt ridge by additional dirt placed over the liner's edges. However, the dirt berm technique is generally unsuitable for indoor use, and requires dirt of sufficient packability and stability to maintain a proper berm shape without failing. Moreover, the dirt berm system is easily damaged by weather. Additionally, the berms require substantial physical effort to construct, and can be difficult to maintain in proper shape.

Another shortcoming of prior berm systems such as described above is that they lacked any practical, efficient means to erect and support a load-bearing platform above the containment area.

It is a primary purpose of the present invention to provide a modular containment system which can be assembled into a wide variety of shapes, where the modules, both alone and when interlinked, have high stability to resist outward pressures against the berm walls and to retain the assembled structure's shape, as well as to support a load bearing platform, and whereby the modules can be disassembled and reassembled easily.

SUMMARY OF THE INVENTION

The berm modules and containment system of this invention enable the construction of large containment structures, for containing hazardous materials that may spill during industrial processes, paint stripping processes, etc. or that may leak from ruptured storage containers. An important advantage is that the containment system of the invention can be erected very quickly, and can be located inside a building or outdoors.

The modules are large sections, preferably hollow and of high strength plastic material, with each module having an interlock means at each end. The interlock means at one end of a module comprises a projection, with the projection sized to fit into a slot which forms the interlock means at the other end of the module. When assembled, the projection of one module snugly fits into the slot of an adjacent module, with the projection and slot being formed such that interlinked modules cannot be pulled apart by longitudinal forces or forced apart by lateral (i.e. outward) forces against the perimeter of the assembled containment structure. Additionally, the interlock prevents rotational flexing between two adjacent modules, so that the angle between adjacent modules will remain constant and the perimeter of the structure will not be substantially deformed by lateral forces from within the contained area.

The plastic modules are preferably hollow, equipped with a closable opening at or toward the top so that they may be filled with water or sand, to increase their stability and strength. When assembling a containment structure, the modules may be kept hollow so that they are light in weight and easy to handle. After the structure is assembled, the modules can be filled. Individual modules may be side or end units, corner units, or curved units, so that the resulting structures may be in a variety of shapes.

In one preferred embodiment of the invention the plastic modules have a width which is on generally the same order as their height, so that an individual module is free-standing and has a high stability and is strongly resistant to tipping. When the module is filled with, for example, sand or water, the module becomes even more stable and resistant to tipping forces. When the modules are combined into a structure, the moment-resisting interlocking connections provide additional stability, and when combined with the inherent stability of individual modules the interlocked condition creates a structure which is highly stable against lateral forces.

Once the modules are assembled to form a perimeter, a liner is installed which will enclose the interior of the structure, to contain any materials which may spill into the area. The modules preferably have a liner retention device, which holds the liner in place around the perimeter. In a preferred embodiment, the liner retention device is a groove which runs along the top of the module, and when the modules are assembled into a containment unit the groove runs from module to module and effectively encircles the perimeter of the structure. The liner is spread over the enclosed area with its edges placed in this groove. A flexible tube is forced into the groove as a locking device. Pressure between the tube and the groove hold the liner securely in place. For disassembly, the tube is removed, releasing the liner.

In a specific embodiment, the berm system is equipped with a deck which can be assembled over the berms, the deck serving as a floor for equipment and personnel to stand and work on. The deck preferably has openings in it, so that drippings or particles which are spilled or dropped will fall into the contained area. If desired a deck over the containment area may be solid and imperforate, to serve as a lid or cover over a contained area of hazardous material for long term storage. A lighter deck can be used for this purpose, not load-supporting. Alternatively, an imperforate sheet material can be installed over the perforated load-supporting deck.

It is therefore among the objects of the invention to provide a versatile modular containment system construction, for enclosing a defined, desired perimeter and containing hazardous material within that perimeter, wherein the modules can be put together and disassembled easily. The modules and the assembled structure are resistant to displacement by lateral forces, and can be filled to increase their weight, strength, and stability. With a deck or platform above the area, considerable loads can be supported. These and other objects, advantages and features of the invention will be apparent from the following description of preferred embodiments, considered along with the accompanying drawings.

DESCRIPTION OF PREFERRED EMBODIMENTS

Figure 1:
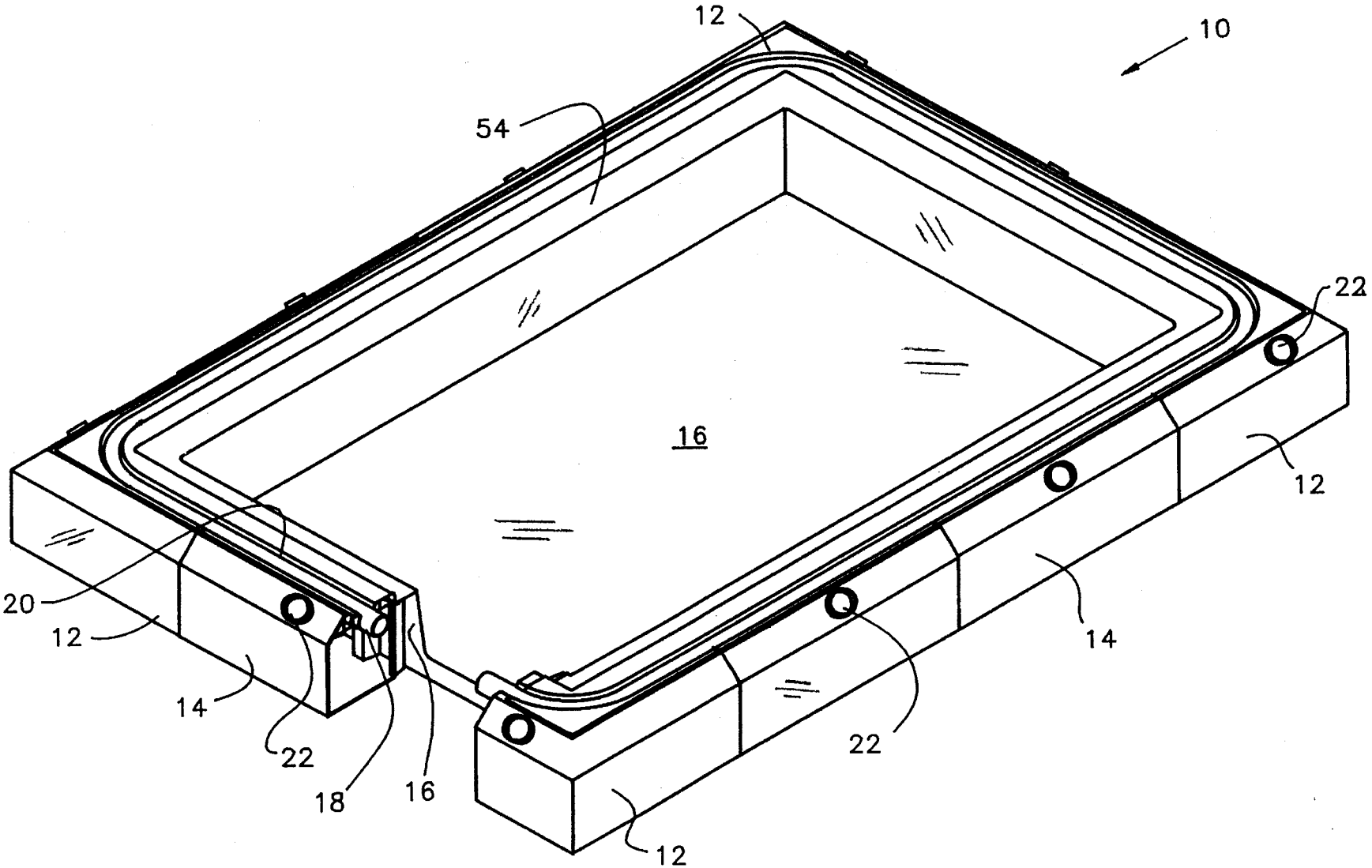
FIG. 1 is a perspective view showing an assembled containment system in accordance with a preferred embodiment of the invention, with a liner and part of a structural berm shown partially cut away.

FIG. 1 shows a containment system 10 made up of corner berm modules 12, side (or end) modules 14, and a liner 16. In the example shown, four corner modules 12 and six side (end) modules 14 are interconnected to form a rectangular containment system or perimeter structure. Part of a side (end) module 14 and a corner module 12 at the near corner are removed to reveal detail, as well as part of the liner 16 in that region. In FIG. 1 the structure does not contain a platform or deck.

When the modules are assembled into the system, a continuous groove or channel 20 passes along the top of the side and corner modules, encircling the top perimeter of the system 10 as shown. When the liner 16 is installed in the containment system, the liner will overlie the groove 20 where the liner passes over the side and corner modules, passing over and beyond the groove. To hold the liner 16 in place, a clip-in tube 18 is inserted into the groove by forcing and snapping it into the groove with the liner between the tube and the groove. Pressure between the tube 18 and the groove 20 holds the liner in place. This relationship is better seen in the enlarged view of FIG. 1C.

The liner 16 is of an impervious flexible plastic sheet material, such as polyethylene. In any event, the material is selected to be resistant to the hazardous or caustic materials which it is intended to contain.

Figure 2:
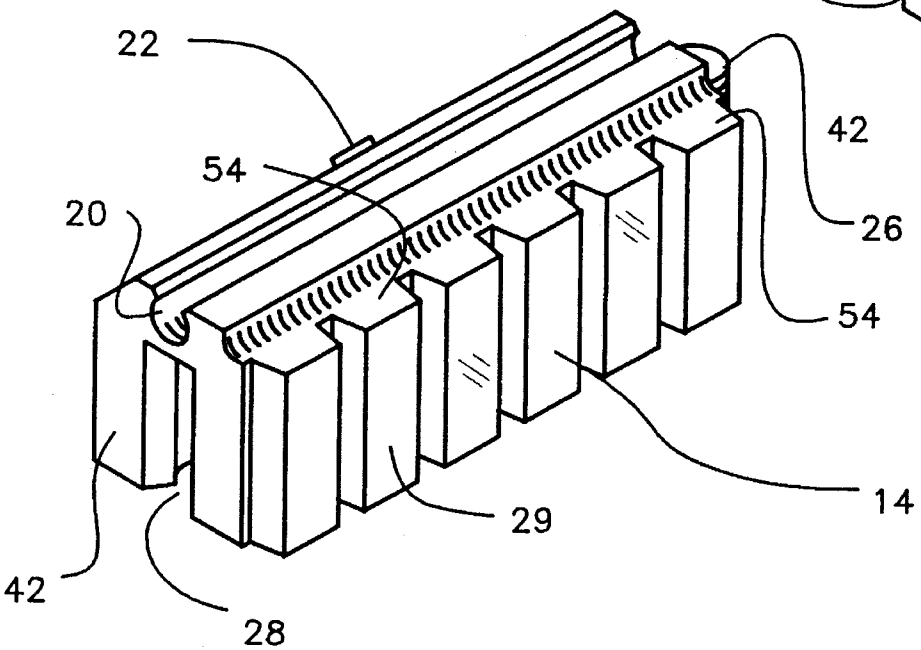
FIG. 2 is a perspective view of a side unit module of the invention.

FIG. 2 shows a side module 14 having a male connector 26 on one end, with a connector groove or female connector 28 at the opposite end. In the embodiment shown, the module is on the order of four feet in length, and about one foot to one and one half feet in both height and width. Other dimensions can be used. One side of the module is corrugated in this preferred embodiment, with the corrugated side 29 intended to face inward, i.e. toward the area enclosed by an assembled containment structure formed of the various modules. The corrugation improves the strength of the module, protecting against excessive deformations from outward pressures caused by materials contained within the containment structure 10 (FIG. 1). Toward the top of the module 14 is a preferably closable opening 22, through which the hollow module can be filled with a ballast such as, for example, water or sand, to increase the stability and strength of the module. The openings 22 are reinforced and preferably include closures. The tank modules 12 and 14 could be used for the dual purpose of storing certain liquids if desired, so long as the liquids are not needed while the containment structure is relied upon to hold back the pressure of a pool of liquid. The liner retainment groove 20 runs lengthwise along the top of the module 14.

Figure 2A:
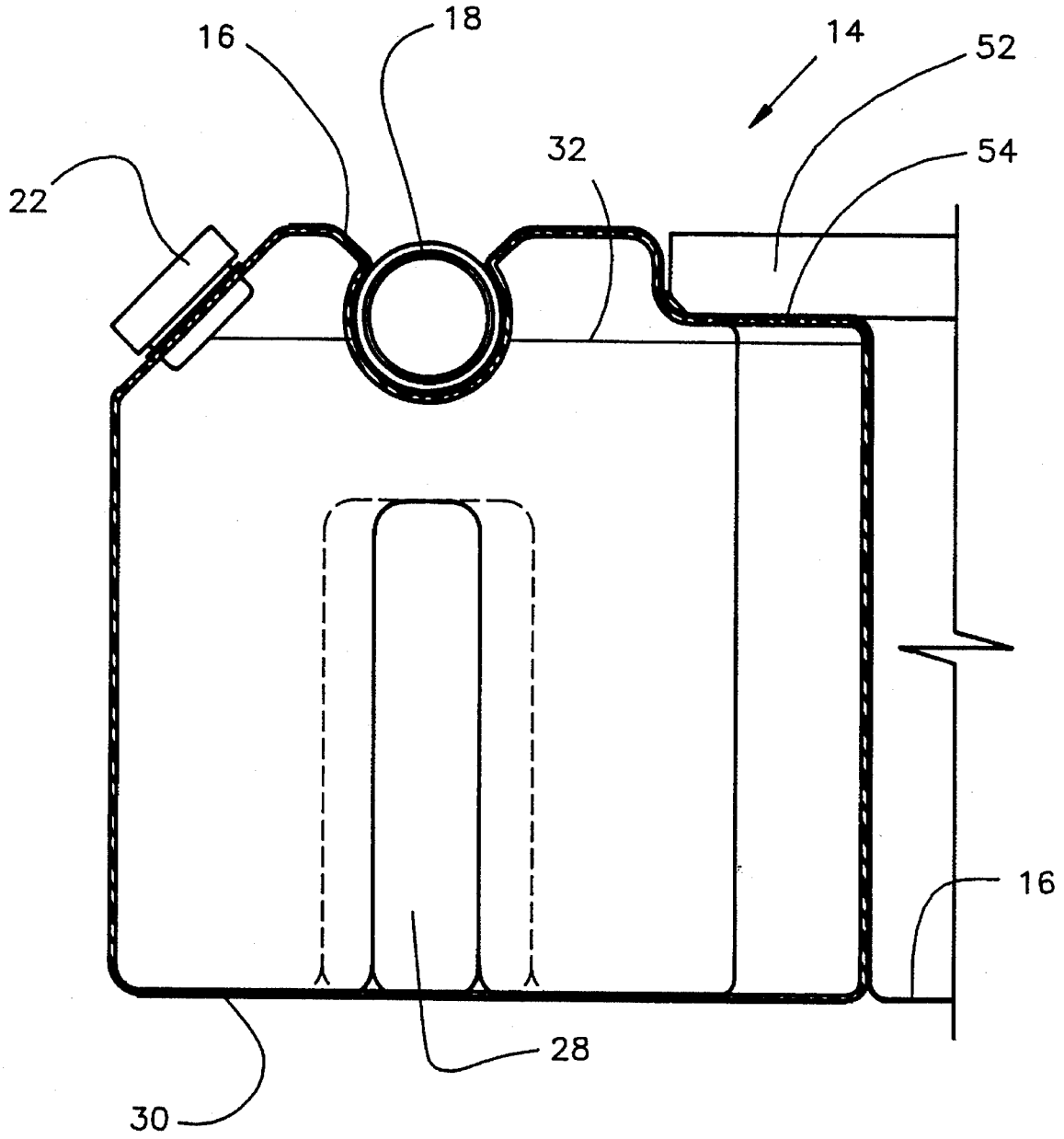
FIG. 2A is an elevational cross section view of a side module of the invention, indicating a deck supported on the models.

A cross section of a side or end unit 14 is shown in FIG. 2A. In the embodiment shown, the width w of the module is on generally the same order as the height h of the module. This improves the stability of the module, making it resistant to lateral forces that may tend to tip a less stable design. For a given system, all modules, including side, corner, and curved modules, preferably have basically the same cross sectional characteristics and dimensions, and are generally interchangeable. It should be noted that the height may be substantially greater or less than the width of a module, depending on the stability desired, the fill in the module, and the particular use. The important consideration is that the berm module have the stability to resist tipping or outward sliding when in use. If the system is designed to carry liquid substantially to the height of the berm modules, then the width and height relationship should be such that when filled with ballast, the berm module will not tend to tip if the containment area is filled to the top of the modules with liquid or slurry. The ballast for this purpose can be assumed to be water. A surface 32 of water, sand or other liquid or granular material within the tank module 14 is indicated in FIG. 2A. As shown in the drawing, the module preferably has a substantially flat load-bearing bottom 30 for stability.

The tank modules 12 and 14 are formed of any suitable material which is relatively lightweight and strong. Plastics such as polyethylene may be used (low or high density, depending on stresses involved), molded by rotocasting, for example.

FIG. 2A shows in better detail the liner locking tube or snap-in tube 18 retaining the liner 16 in place on the tank module 14. In a preferred embodiment the locking tube 18 may comprise a flexible, corrugated irrigation tube such as manufactured by Advanced Drainage Systems of Columbus, Ohio. After assembly of the perimeter modules (as in FIG. 1 or FIG. 1D, for example), the liner 16 is placed over the top of the modules such that the liner passes into the continuous groove 20. The snap-in tube 18 is forced into the groove 20, with the tube 18 having a diameter just smaller than or about equal to the diameter of the groove 20. The tube, as well as the groove 20 to a lesser degree, will deflect somewhat to achieve the snapping in of the tube. Pressure between the tube 18 and the groove 20 holds the liner 16 in place. The release the liner, the tube 18 can snapped out of the groove 20, after which the liner 16 may be easily removed.

Figure 1A:
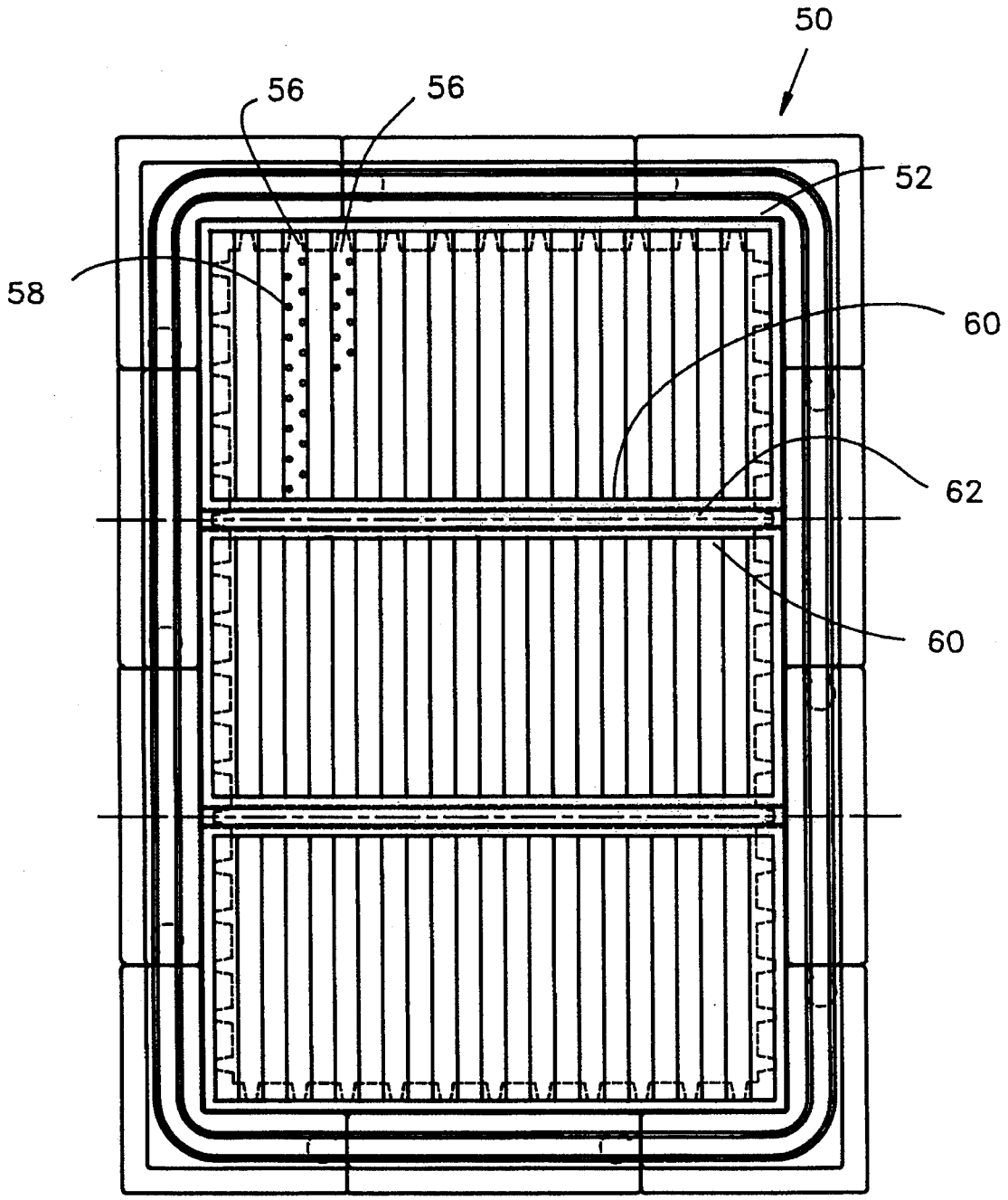
FIG. 1A is a plan view, again showing an assembled containment system of the invention, with a deck supported by perimeter modules of the assembly.
Figure 1B:
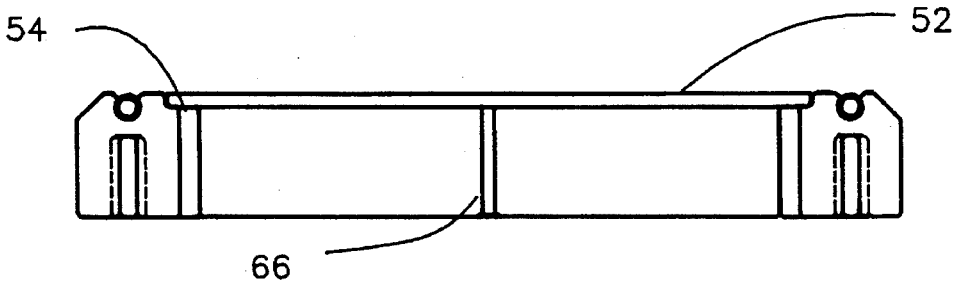
FIG. 1B is a sectional view in elevation showing the containment system of FIG. 1A.
Figure 1C:
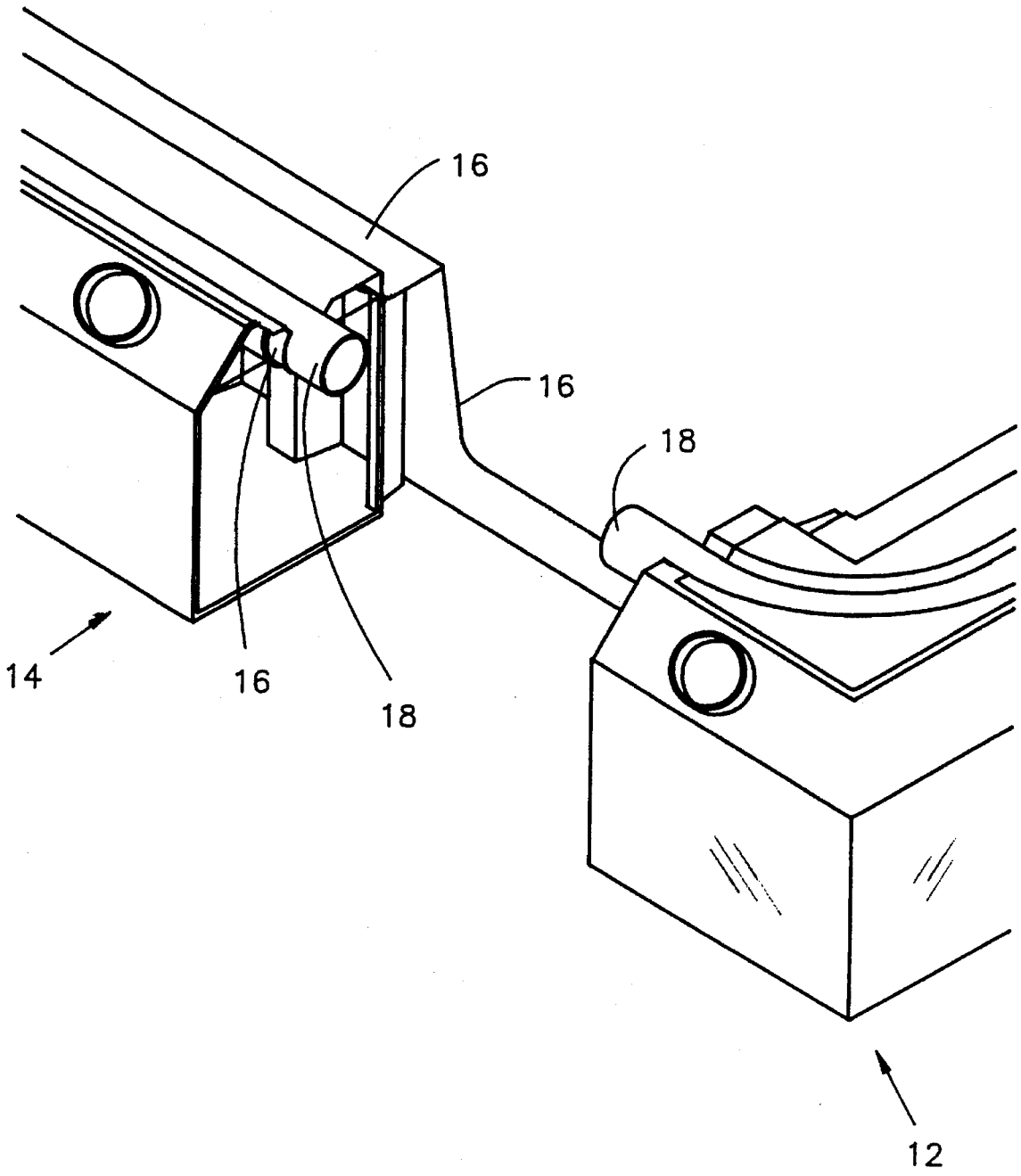
FIG. 1C is an enlarged perspective view showing a portion of the structure of FIG. 1.
Figure 1D:
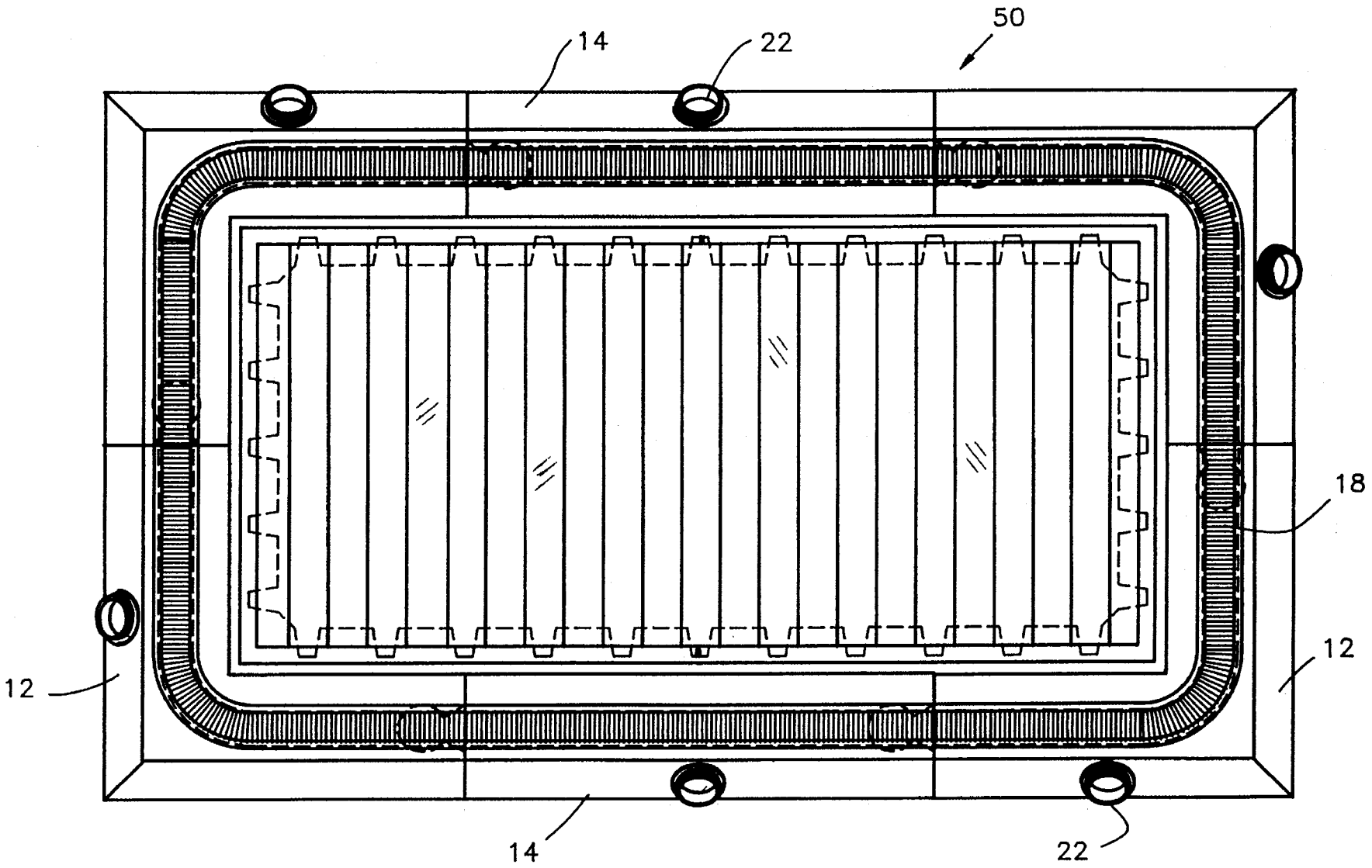
FIG. 1D is another plan view of an erected system of the invention, showing a smaller containment structure with fewer modules.

FIG. 1D, showing a containment structure made up of only four corner modules 12 and two side modules 14, better illustrates the pleated or corrugated snap-in tube 18 in place on the perimeter.

Figure 3:
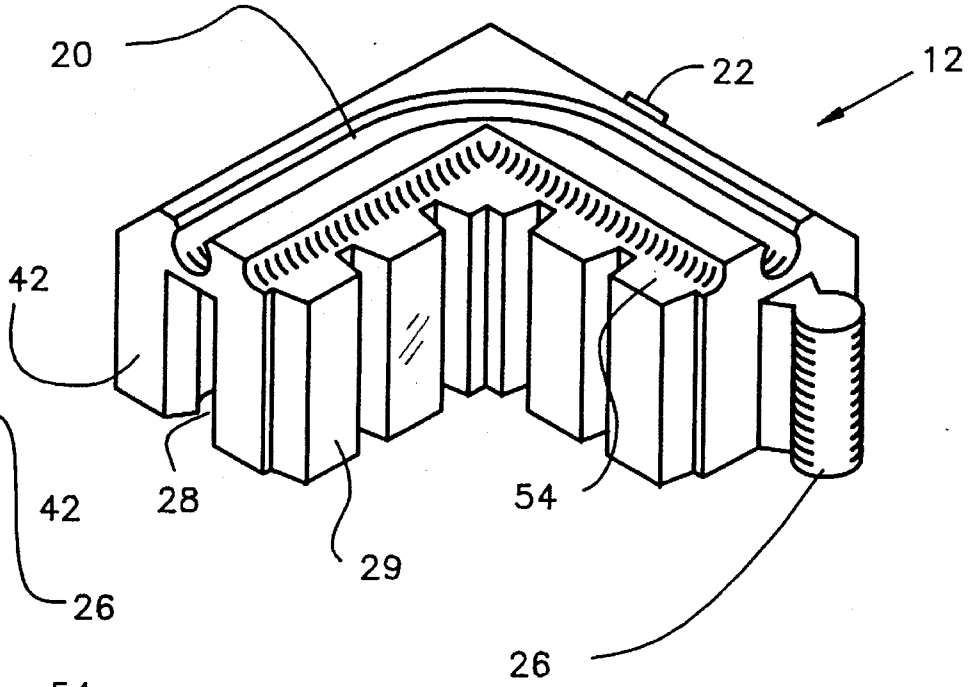
FIG. 3 is a perspective view of a corner module in the invention.

A corner module 12 is shown in FIG. 3. Similar to a side module 14 in construction, the corner module 12 has a connector groove or female connector 28 at one end and a connector tab or male connector 26 at the opposite end, generally keyhole-shaped in the preferred embodiment shown, with a cylindrical portion for nesting into the similarly and complementary shaped groove 28. As in the side module, the internal side of the corner module is corrugated for strength, and the liner retainment groove 20 runs along the top of the module. The unit is provided with a fill hole 22 at or toward the top of the module, through which water, sand, or other fill materials may be added.

Figure 4:
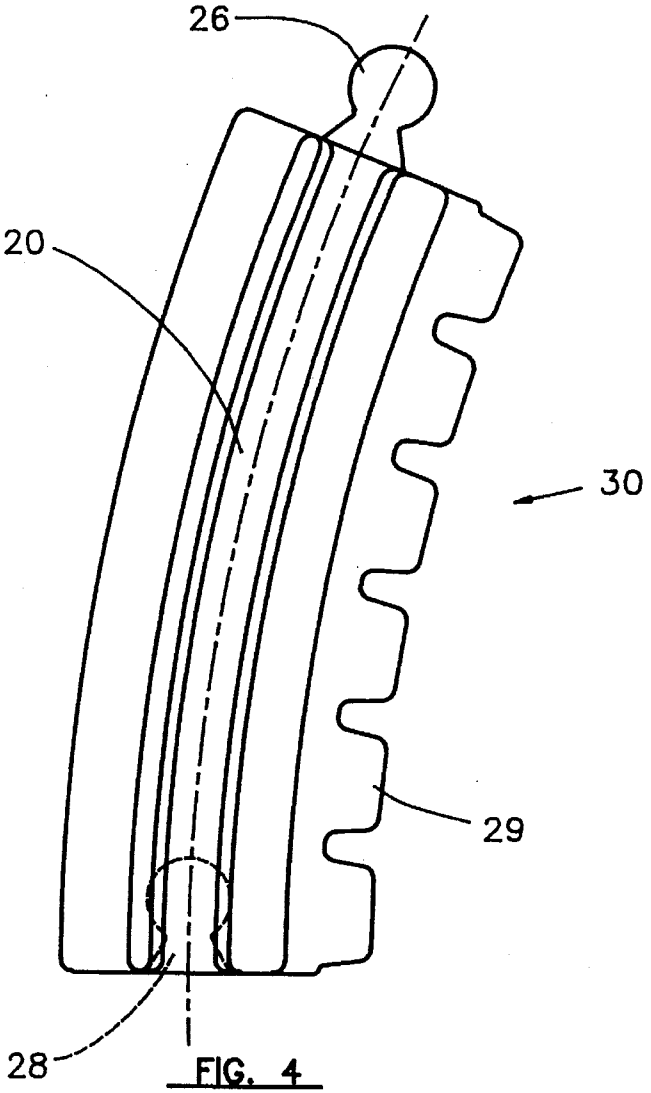
FIG. 4 is a plan view of a curved module of the invention.

A curved module 31 is shown in FIG. 4, having characteristics similar to the corner and side modules. As in the other modules the curved module 31 has a connector groove or cavity 28, at one end and a connector tab 26 at the opposing end. Again the internal side 24 of the module is corrugated for strength, and a fill hole 22 is positioned at or toward the top of the module. The liner retainment groove 20 runs along the top of the module 31. The curved module can be used with other curved modules to form circular enclosures, or in combination with side and/or corner modules to form a variety of containment structure shapes.

Figure 3A:
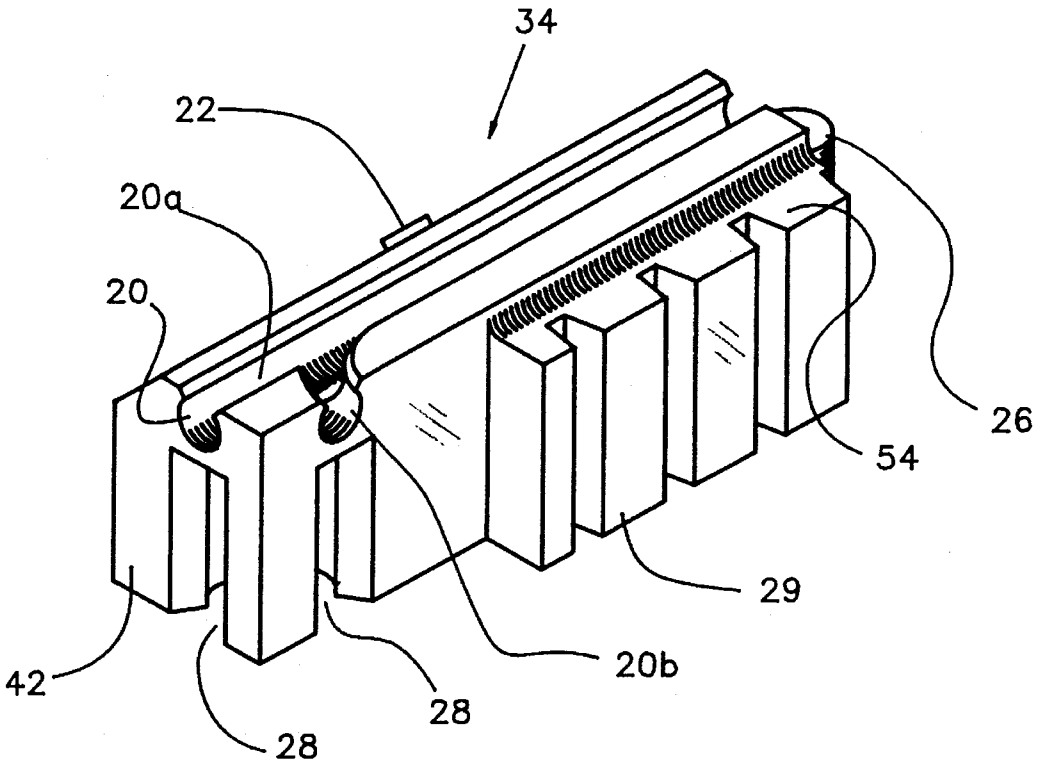
FIG. 3A is a perspective view of a modified side or end module.

It should be understood that the corner modules 12, although having the advantage of great stability, can be eliminated if a side connection is provided near the end of a regular side or end module as shown in the modified module 34 of FIG. 3A. The side connector should be a female connector 28 as shown, so as not to protrude objectionably into the containment area. The snap-in track or groove 20 can have two alternative branches 20*a* and 20*b*, as shown, depending on how the side/corner module 34 is used. The module 34 thus enables a single type of module to be used for the entire perimeter assembly. The strong interlocking connection provided by the connectors 26 and 28 shown will form a corner of high integrity even without use of the dedicated corner module 12. It should also be understood that the module 34 could be modified to have only one female connector 28, i.e. the one defining the corner capability, with the track or groove eliminating the straight branch 20*a*, to serve as a dedicated corner module to be used in combination with side (end) modules as in FIG. 2. If such corner modules are dedicated to the corner purpose, the positions of the male and female connectors 26 and 28 could be reversed if desired.

Figure 5:
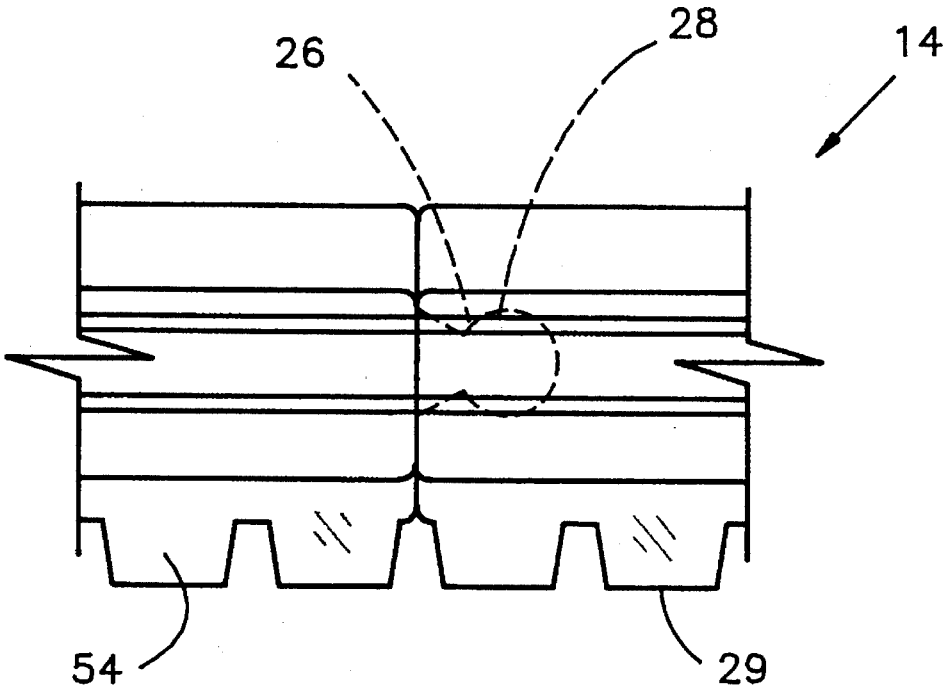
FIG. 5 is a top plan view showing the end to end connection between two modules.
Figure 5B:
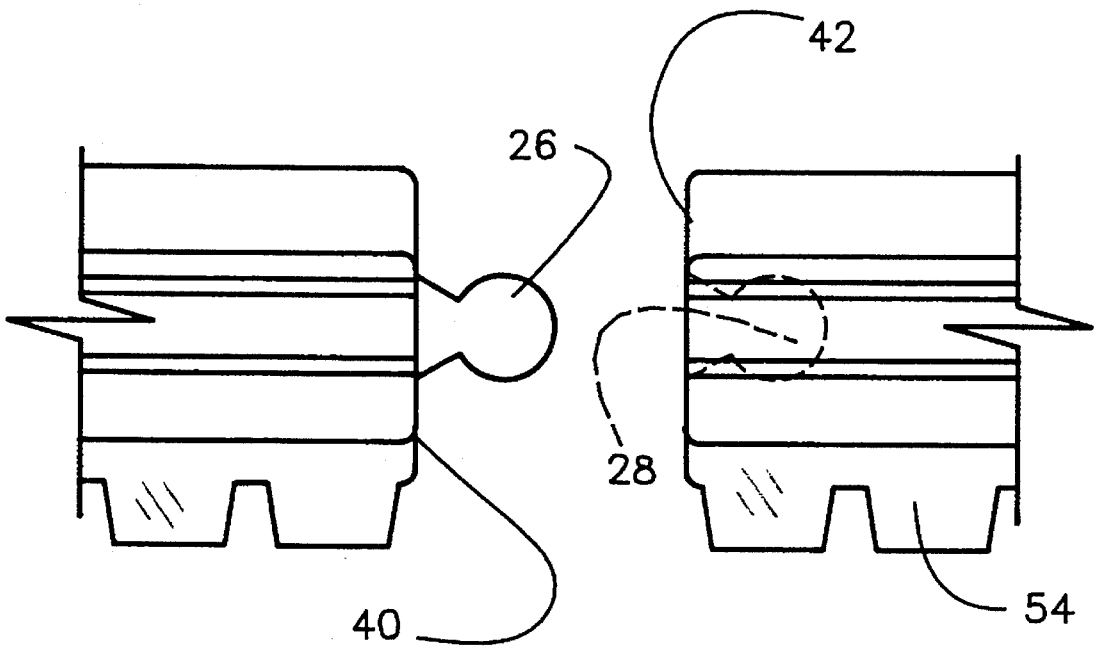
FIG. 5B is an exploded plan view of the connection shown in FIG. 5.
Figure 5A:
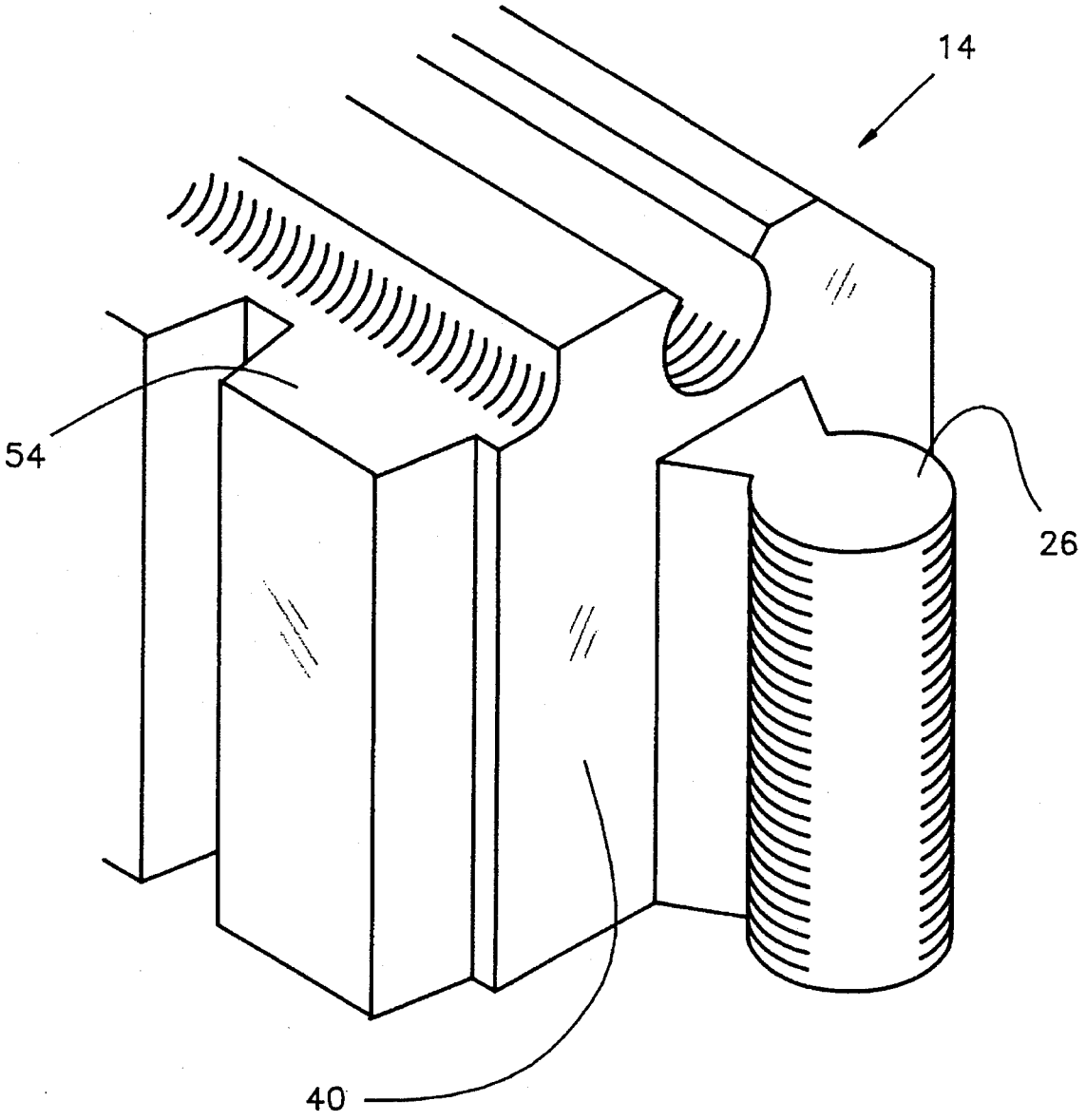
FIG. 5A is a perspective view showing a protruding connector on one end of a module.

FIG. 5 is a close up view looking down onto the interconnected ends of two modules, with FIG. 5B showing the two modules separated, before connection. FIG. 5A shows the male connector 26 in perspective. The module on the left has a connector tab or male connector 26 which is inserted into the connector groove or female connector 28 of the module 14 on the right. This is accomplished by placing the left module first, then lowering the right module into place immediately adjacent, such that the male connector 26 enters slidingly into the female connector 28, as a pin sliding into a complementary socket. The shape of the male and female connectors 26 and 28 prevents the modules from being pulled apart. Additionally, the connection system holds the end surfaces 40 and 42 of the modules substantially together, preventing rotational flexing (about a vertical or horizontal axis) between the modules.

A structure formed of these interconnected modules 12, 14 and/or 31 will have substantially improved stability over prior berm systems or methods. Individual modules have substantial stability because of their wide bases, and that stability can be further enhanced by filling the hollow modules with water or sand. Moreover, when modules are interconnected into a large containment system, the moment-resisting interconnections provide additional stability. The resulting containment structure has very high strength and stability.

FIGS. 1A and 1B show a containment system 50 similar to that shown in FIG. 1, but with a deck or platform 52 included. The deck 52 covers the top of the containment structure and is supported on interior shoulders or ledges 54 of the perimeter modules, with the liner 16 between. This support arrangement is best seen in FIGS. 1B and 2A, and the support shoulders themselves are also illustrated in FIGS. 1, 2, 3, 4, 5, 5A and 5B. The purpose of the structural deck 52 is to provide a strong load bearing platform on which equipment, storage containers, etc. can be located. Any leaking, spilled or dropped contaminants or potentially hazardous materials will drop through the deck 52 and into the containment area defined by the perimeter modules and the liner 16. For this purpose, deck slats 56 of the platform or deck 52 include holes 58, as indicated on several of the planks in FIG. 1A (preferably all planks include such holes). The holes 58 may be in the form of elongated slots or circular holes, but in any event preferably are staggered so as not to severely limit the flexure strength of the planks 56.

It should be understood that curved modules can also be used in assembling a deck-supporting containment structure according to the invention, which might be circular, race-track-shaped or other perimeter shapes.

If the containment structure 50 is to store hazardous material for an extended period, it may be covered with an imperforate sheet of plastic material (not shown). Alternatively, the deck structure 52 may be replaced with a similar, but imperforate and lighter deck structure as a cover, since load bearing would not be its function.

The deck structure 52 may be constructed in accordance with the disclosure of either U.S. Pat. No. 5,050,361, or of application Ser. No. 932,491, filed Aug. 20, 1992, both being owned by the assignee of the present invention. Both the patent and the application are incorporated by reference herein. The load bearing structure 52 includes the deck slats or planks 56, structural deck channels 60 within which the ends of the slats 56 are received, and structural cross members 62 which are connected to the deck channels 60, as better seen in the sectional view of FIG. 6.

Figure 6:
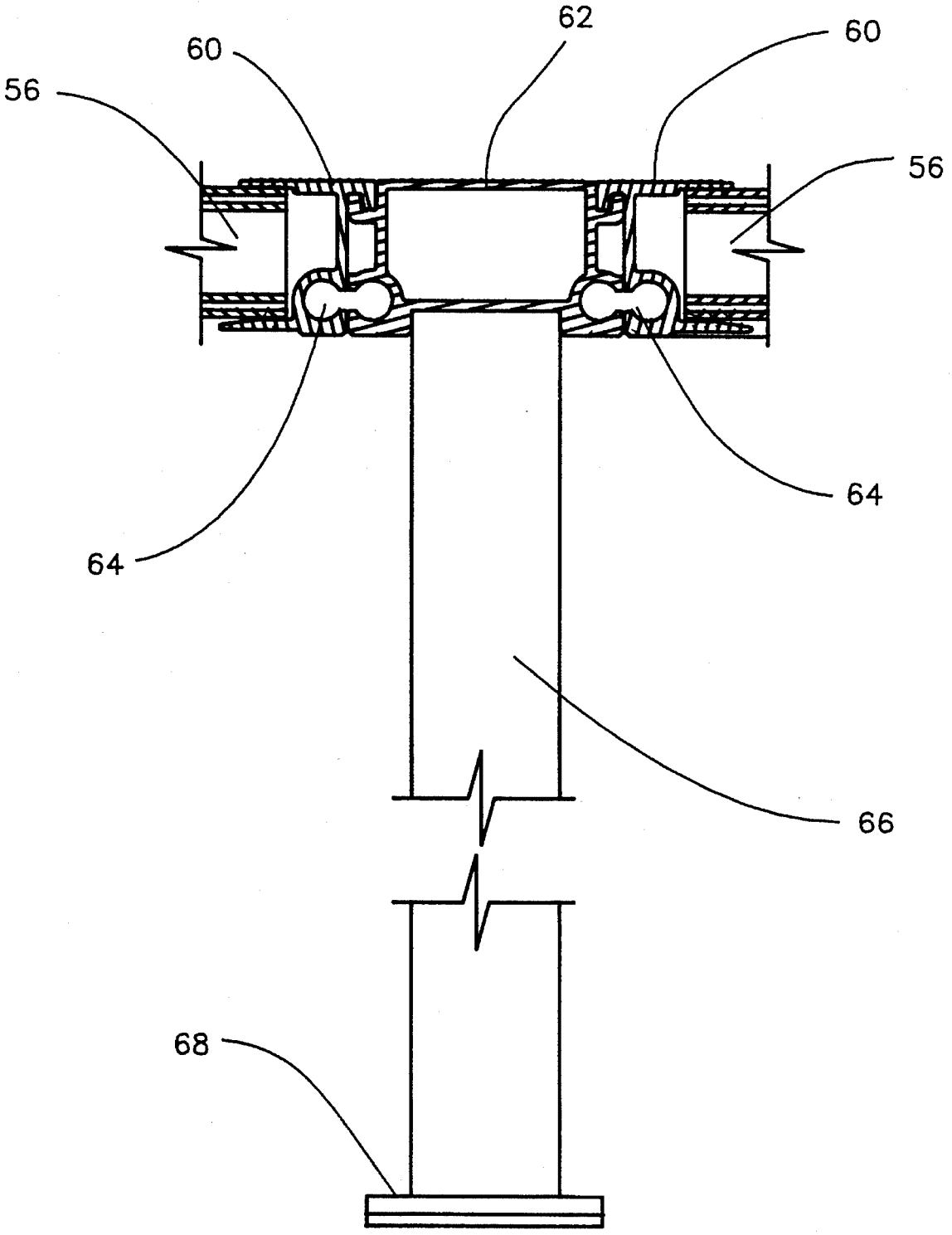
FIG. 6 is an elevation view in section, showing a portion of the containment system as illustrated in FIG. 1B, namely an internal support for the deck structure.

Interconnection structure 64 is also included in the assembly, as disclosed in detail in the referenced copending application. FIG. 6 indicates this interconnection structure, as one example of a system that can be employed.

FIG. 6 also shows one of several intermediate support columns or posts 66, an example of the position of which is illustrated in FIG. 1B. Such intermediate columns 66, which may have stable footing supports 68 as shown in FIG. 6, are included as needed for supporting heavy loads when the size of the containment structure 50 and the spans involved would require such intermediate support.

The invention provides for fast, efficient and economical erection of a containment structure, particularly for secondary containment of hazardous or toxic materials as is frequently required in industrial contexts. The berm modules are light in weight when empty and are easily interlocked together, one by one, to form a perimeter in the size and shape desired. Water, sand or other ballast material is added, and the plastic sheet liner is put in place and engaged to the perimeter with the tubular locking device. At that point the containment structure is ready for use for containing leaked materials, etc. from vessels or objects placed in the area. With a structural, open deck secured to the perimeter and over the containment area, tanks, drums, vehicles, equipment or other heavy articles may be positioned on the deck. Work may be performed on objects on the deck, such as stripping of lead-containing paints off vehicles or equipment. Industrial equipment or machinery may be positioned on the deck. A simple ramp (not shown) can be provided for transferring vehicles, drums, etc. up onto the deck.

The system of the invention is particularly useful for containment of hazardous or potentially hazardous materials, especially as a rapidly-deployable system, but it has other uses as well. It is advantageously used, for example, wherever a pool of liquid is to be contained, up to several feet deep.

The above described preferred embodiments are intended to illustrate the principles of the invention but without limiting its scope. Other embodiments and variations to these preferred embodiments will be apparent to those skilled in the art and may be made without departing from the essence and scope of the invention as defined in the claims.

I claim:

1. A containment system for receiving and collecting materials leaked or spilled from containers or dropped from an industrial process or other activity conducted over a containment area, comprising:

a series of portable berm modules, each formed of a relatively lightweight material and having a hollow interior, with a generally stable cross section to resist outward tipping and with interconnection means on each berm module for interlocking the module with immediately adjacent modules so as to form a perimeter assembly with a plurality of the berm modules connected end to end to define the containment area, fill means permitting filling of the modules with water, sand or other suitable ballast material to add stability to the modules when assembled together into the perimeter assembly, liner means formed of imperforate plastic sheet material, for overlying the containment area and extending at least partially up onto the berm modules of the perimeter assembly, to thereby contain solid or liquid materials within the containment area and generally up to the height of the berm modules of the perimeter assembly, and liner connection means for securing the liner to the perimeter assembly, near the top of each berm module of the assembly, comprising a groove or channel formed in each berm module, located to align with similar channels in adjacent berm modules to form a continuous channel in the perimeter assembly and positioned to be covered by the liner when the liner is in place over the containment area, and snap-in engagement means of a size to fit tightly in the channel with the liner pushed into the channel so as to tightly retain the liner in the channel.

2. A containment system according to claim 1, wherein the snap-in engagement means comprises a flexible tube of slightly larger diameter than the width of the channel.

3. A containment system according to claim 2, wherein the flexible tube comprises a pleated plastic tube.

4. A containment system according to claim 3, wherein the tube is substantially continuous around the perimeter assembly.

5. A containment system for receiving and collecting materials leaked or spilled from containers or dropped from an industrial process or other activity conducted over a containment area, comprising:

a series of portable berm modules, each formed of a relatively lightweight material and having a hollow interior, with a generally stable cross section to resist outward tipping and with interconnection means on each berm module for interlocking the module with immediately adjacent modules so as to resist tipping or rotation of the module relative to adjacent modules and so as to form a perimeter assembly with a plurality of the berm module is connected end to end to define the containment area, the interconnection means comprising a female connector on one end of a module and a male connector on the other end, the male connector comprising an elongated generally vertical pin member extending from the berm module by connecting structure narrower than the width of the pin member, and the female connector comprising an elongated generally vertical socket closely fitted to the size of the pin member for closely receiving the pin member of an adjacent berm module by vertical manipulation of one of the berm modules relative to the other, and wherein the vertical socket of the female connector is recessed in the end of the berm module, at a position such that the ends of the two modules are closely nested together when the pin member is in the socket, so that the two modules are closely interlocked to resist relative rotation about a vertical axis, fill means permitting filling of the modules with water, sand or other suitable ballast material to add stability to the modules when assembled together into the perimeter assembly and liner means formed of imperforate plastic sheet material, for overlying the containment area and extending at least partially up onto the berm modules of the perimeter assembly, to thereby contain so lid or liquid materials within the containment area and generally up to the height of the berm modules of the perimeter assembly.

6. A containment system for receiving and collecting materials leaked or spilled from containers or dropped from an industrial process or other activity conducted over a containment area, comprising:

a series of portable berm modules, each formed of a relatively lightweight material and having a hollow interior with a generally stable cross section to resist outward tipping and with interconnection means on each berm module for interlocking the module with immediately adjacent modules so as to resist tier rotation of the module relative to adjacent modules and so as to form a perimeter assembly with a plurality of the berm modules connected end to end to define the containment a real each berm module having an inner side toward the containment area, and the inner side of the module having vertical corrugations, exposed toward the containment area, for increased strength, fill means permitting filling of the modules with water, sand or other suitable ballast material to add stability to the modules when assembled together into the perimeter assembly, and liner means formed of imperforate plastic sheet material, for overlying the containment area and extending at least partially up onto the berm modules of the perimeter assembly, to thereby contain solid or liquid materials within the containment area and generally up to the height of the berm modules of the perimeter assembly.

7. A containment system for receiving and collecting materials leaked or spilled from containers or dropped from an industrial process or other activity conducted over a containment area, comprising:

a series of portable berm modules, each formed of a relatively lightweight material and having a hallow interior, with a generally stable cross section to resist outward tipping and with interconnection means on each berm module for interlocking the module with immediately adjacent modules so as to form a perimeter assembly with a plurality of the berm modules connected end to end to define the containment area, fill means permitting filling of the modules with water, sand or other suitable ballast material to add stability to the modules when assembled together into the perimeter assembly, liner means formed of imperforate plastic sheet material, for overlying the containment area and extending at least partially up onto the berm modules of the perimeter assembly, to thereby contain solid or liquid materials within the containment area and generally up to the height of the berm modules of the perimeter assembly, the berm modules being assembled into a perimeter assembly surrounding a containment area with the liner means installed over the containment area and secured to the perimeter assembly, the berm modules further including deck support means extending toward the containment area for receiving a load at an elevated position on the berm modules, and including load bearing deck means supported on the deck supporting means of the perimeter assembly with the liner means between, for receiving heavy equipment or storage tanks and having openings for dropping of materials through the deck means into the containment area.

8. A containment system according to claim 7, wherein the deck support means comprises a ledge on each berm module extending toward the interior of the containment area and formed by the top surface of a series of corrugations on the inner side of the berm module.

9. A containment system according to claim 7, further including interior support means for supporting the deck means at the interior of the containment area, spaced from the berm modules, in addition to the deck support means of the perimeter assembly.

10. A containment system for receiving and collecting materials leaked or spilled from containers or dropped from an industrial process or other activity conducted over a containment area, comprising:

a series of portable berm modules, each formed of a relatively lightweight material and having a hollow interior, and with a stable cross section to resist outward tipping, the berm module having a generally flat base having a base width which is great enough relative to the berm module's height that with the berm module filled with water, it will not tend to tip outwardly when the containment area holds liquid of water's density up to the full height of the berm module, and with interconnection means on each berm module for interlocking the module with immediately adjacent modules so as to form a perimeter assembly with a plurality of the berm modules connected end to end to define the containment area, fill means permitting filling of the modules with water, sand or other suitable ballast material to add stability to the modules when assembled together into the perimeter assembly, the module's hollow interior being closed except at the fill means, and liner means formed of imperforate plastic sheet material, for overlying the containment area and extending at least partially up onto the berm modules of the perimeter assembly, to thereby contain solid or liquid materials within the containment area and generally up to the height of the berm modules of the perimeter assembly.

* * * * *